US007413424B2

(12) United States Patent
Wanschura et al.

(10) Patent No.: US 7,413,424 B2
(45) Date of Patent: Aug. 19, 2008

(54) GEAR PUMP AND HOLDING ELEMENT THEREFOR

(75) Inventors: Guenter Wanschura, Ulm (DE); Wolfram Kudermann, Senden (DE); Reinhold Schniederjan, Neu-Ulm (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 372 days.

(21) Appl. No.: 10/550,845

(22) PCT Filed: Mar. 25, 2004

(86) PCT No.: PCT/EP2004/003186

§ 371 (c)(1),
(2), (4) Date: Sep. 23, 2005

(87) PCT Pub. No.: WO2004/106744

PCT Pub. Date: Dec. 9, 2004

(65) Prior Publication Data

US 2006/0193741 A1 Aug. 31, 2006

(30) Foreign Application Priority Data

Jun. 3, 2003 (DE) ..... 103 25 025

(51) Int. Cl.
*F01C 1/02* (2006.01)
*F01C 1/063* (2006.01)

(52) U.S. Cl. ..... 418/61.3; 277/640

(58) Field of Classification Search ..... 411/22, 411/44, 45, 49, 80.1–80.5, 324
See application file for complete search history.

(56) References Cited

U.S. PATENT DOCUMENTS 2,132,813 A * 10/1938 Wahlmark ..... 418/71

(Continued)

FOREIGN PATENT DOCUMENTS

| | | | |
|---|---|---|---|
| DE | 27 58 376 | | 7/1979 |
| DE | 36 20 705 | A1 | 12/1987 |
| DE | 38 29 547 | A1 | 3/1989 |
| DE | 198 35 510 | A1 | 2/2000 |

*Primary Examiner*—Thomas Denion
*Assistant Examiner*—Douglas J. Duff
(74) *Attorney, Agent, or Firm*—Scully, Scott, Murphy & Presser, P.C.

(57) ABSTRACT

The gear pump unit (100) comprises a pump cover (1), an internal rotor (16) mounted rotatably in a recess (9) of the pump cover (1) and formed in a rotationally fixed manner on a driven plug-in shaft (11), and an external rotor (19), which is rotatably mounted in the recess (9) of the pump cover (1) eccentrically relative to the axis of rotation (A) of the internal rotor (16). The external rotor (19) is in mesh with the internal rotor (16) only in a first angle-of-rotation range (α). In a second angle-of-rotation range (β) lying opposite the first angle-of-rotation range (α), the internal rotor (16) is in contact with an inner surface (25) of a web (23), which is disposed in the recess (9). The outer surface (26) is in contact with the external rotor (19). After closing of the recess (9) by a cover plate (27) fastened to the pump cover (1), an admission pressure chamber (21) and a low-pressure chamber (22) are therefore formed in the recess (9). A holding element (33), which is held in the pump cover (1), in the initial assembled state of the gear pump unit (100) holds the cover plate (27) at a fixed angle of rotation on the pump cover (1).

30 Claims, 4 Drawing Sheets

Figure 1:
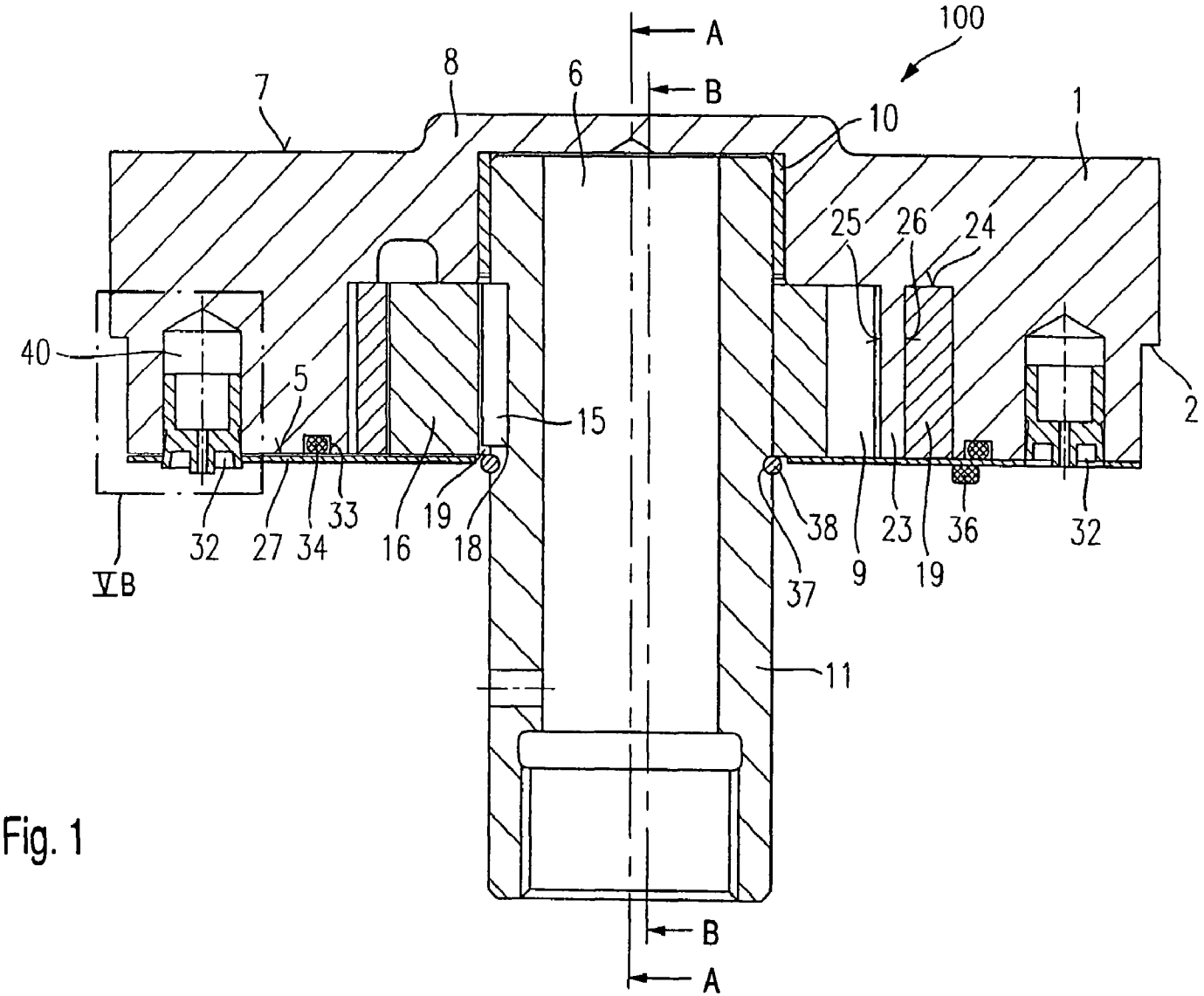

U.S. PATENT DOCUMENTS 2,380,783 A * 7/1945 Painter ..... 417/310
2,615,399 A * 10/1952 Gay ..... 418/169
2,941,439 A * 6/1960 Rapata ..... 411/41
3,315,608 A 4/1967 Eckerle
3,779,674 A * 12/1973 Eckerle et al. ..... 418/71
3,791,779 A 2/1974 Nelson
4,276,806 A * 7/1981 Morel ..... 411/41
4,344,717 A 8/1982 Merz
4,978,266 A 12/1990 Becker et al.
5,106,225 A * 4/1992 Andre et al. ..... 403/408.1
5,259,689 A * 11/1993 Arand et al. ..... 403/337
5,907,891 A 6/1999 Meyer
6,231,223 B1 5/2001 Zucar et al.
6,355,044 B1 * 3/2002 Hair ..... 606/72
6,862,864 B2 * 3/2005 O'Banion et al. ..... 52/800.16
7,097,405 B2 * 8/2006 O'Banion et al. ..... 411/456

* cited by examiner

GEAR PUMP AND HOLDING ELEMENT THEREFOR

The invention relates to a gear pump and a holding element for holding a cover plate at a fixed angle of rotation on the pump cover of the gear pump.

A gear pump according to the preamble of claim 1 is known e.g. from DE 27 58 376 A1 and DE 36 20 705 A1.

Usually the hydraulic fluid for the intake channel of a hydraulic pump is compressed from a hydraulic tank, in which a low pressure prevails, by means of a gear pump to an admission pressure suitable for the intake channel. The gear pump is realized in a pump cover, which is screw-fastened during final assembly onto a connection plate of the hydraulic pump, by means of an internal and external rotor mounted rotatably in a recess of the pump cover. The internal rotor is fastened in a rotationally fixed manner on a plug-in shaft, which is driven by the drive shaft of the hydraulic pump. Because of the eccentric bearing arrangement of the two axes of rotation of the internal and external rotors, the internal and external rotors are in mesh only in a specific angle-of-rotation range $\alpha$ relative to one another. In a second angle-of-rotation range $\beta$ lying opposite the angle-of-rotation range $\alpha$ there is disposed in the recess of the pump cover a sickle-shaped web, with the inner surface of which the internal rotor and with the outer surface of which the external rotor is in contact. By virtue of these engagement and contact points of the internal and external rotors with and/or without interposition of the sickle-shaped web the recess of the pump cover, after closing of the recess with a cover plate, is divided into two pressure chambers. The one pressure chamber is connected by an opening in the cover plate and in the adjoining connection plate to the tank, while in the other pressure chamber by means of the rotation of the internal and external rotors the hydraulic fluid of the first pressure chamber is compressed and fed through an opening in the cover plate and in the adjoining connection plate to the intake channel of the hydraulic pump.

The process of assembling the gear pump on the connection plate of the hydraulic pump is carried out in two steps. During initial assembly, the gear set including the plug-in shaft is mounted in the pump cover. During final assembly, the gear pump assembly is screw-fastened by means of the cover plate to the connection plate of the hydraulic pump. For optimum flow of the hydraulic fluid it is crucial that the two kidney-shaped openings in the cover plate are fixed, on the one hand, in the correct angle-of-rotation position relative to the two pressure chambers in the pump cover and, on the other hand, in the correct angle-of-rotation position relative to the two kidney-shaped openings of the connection plate. The fixing of the kidney-shaped openings in the cover plate in the correct angle-of-rotation position relative to the pressure chambers of the pump cover and relative to the kidney-shaped openings of the connection plate is generally difficult because during final assembly the fitter is unable to see the contact points of the connection.

In a construction hitherto customary for the applicant, the cover plate is screw-fastened to the pump cover without an additional apparatus for effecting fixing at the appropriate angle of rotation. Consequently, because it is impossible to see the connection points, incorrect assembly may occasionally occur and unnecessarily slow down the entire assembly process. This solution also does not allow the cover plate to be held on the pump cover in the event of overhead assembly, thereby adding to the difficulty of the assembly process and reducing occupational safety during assembly.

The underlying object of the invention is therefore to develop the gear pump having the features according to the preamble of claim 1 in such a way that the cover plate is held with its kidney-shaped openings at a fixed angle of rotation on the pump cover, so that the process of assembling the pump cover including the cover plate onto the connection plate of the hydraulic pump may be carried out efficiently with regard to time and with due observance of occupational safety, a further object being to provide a corresponding holding element.

The object of the invention is achieved by a gear pump having the features of claim 1 as well as by a holding element having the features of claim 21. Advantageous developments of the invention are indicated in the dependent claims.

In an initial assembly process, in which the gear set plus plug-in shaft is also fitted into the pump cover, the cover plate is held by holding elements at a fixed angle of rotation on the pump cover. The holding element is preferably inserted into a first recess, which is provided in the side of the pump cover facing the cover plate, and in the course of insertion is deformed in such a way that by virtue of the elastic deformation there builds up in the holding element a bias force, by means of which a force-locking connection to the pump cover is realized. For the design of the force-locking connection between holding element and pump cover—geometry of the holding element relative to the geometry of the first recess in the pump cover, selection of the material of the holding element in dependence upon the material of the pump cover—the weight of the cover plate is to be taken into account.

The holding of the cover plate on the pump cover is effected preferably by means of a positive connection with the aid of the holding element. For this purpose, the holding element is preferably passed by its conical partial body through a second recess in the cover plate, which second recess is positioned opposite the first recess in the pump cover, in such a way that the cover plate, supported by its outer recess edge against the conical partial body of the holding element, is pressed by the holding element positively against the pump cover. The requisite force potential of the conical partial body of the holding element for holding the cover plate is determined as a function of the weight of the cover plate by the exact geometry and the material of the conical partial body of the holding element.

In the final assembled state of the pump cover including the cover plate on the connection plate of the hydraulic pump, the holding elements are pushed fully into the first recesses of the pump cover, so that the cover plate is completely released by the holding elements and held only by the screw connections extending between pump cover and connection plate.

Figure 2:
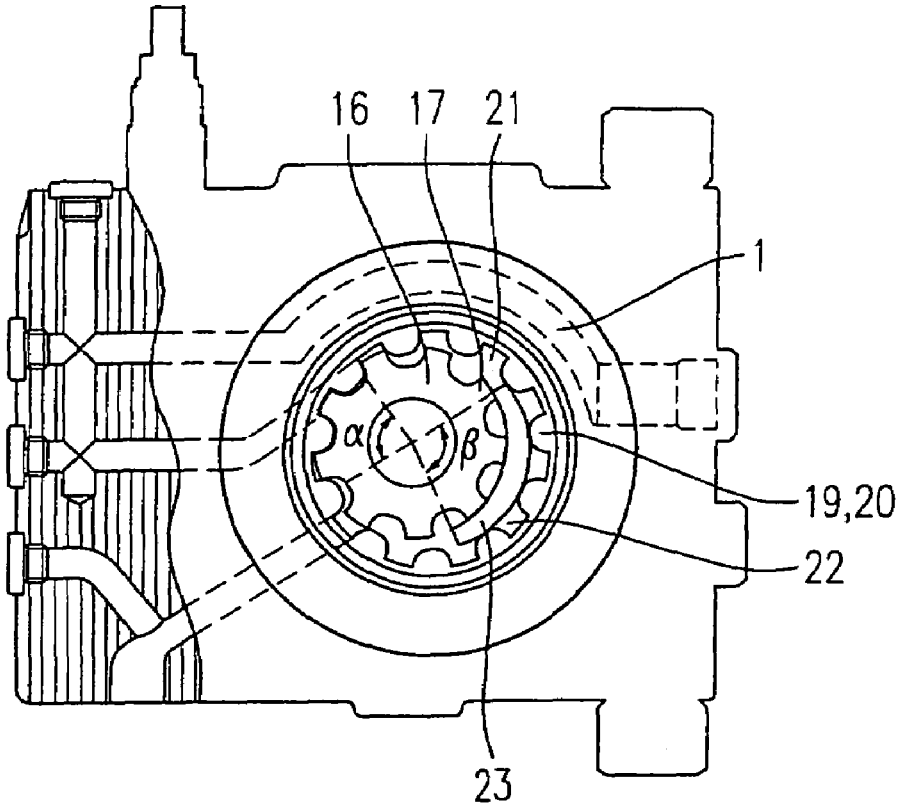
Figure 3:
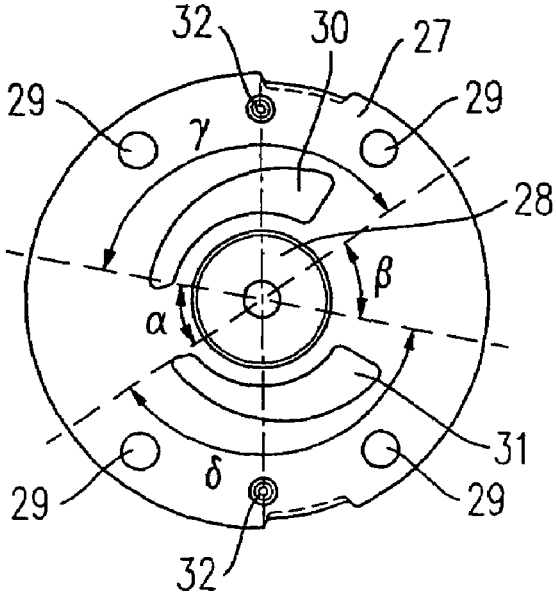
Figure 4:
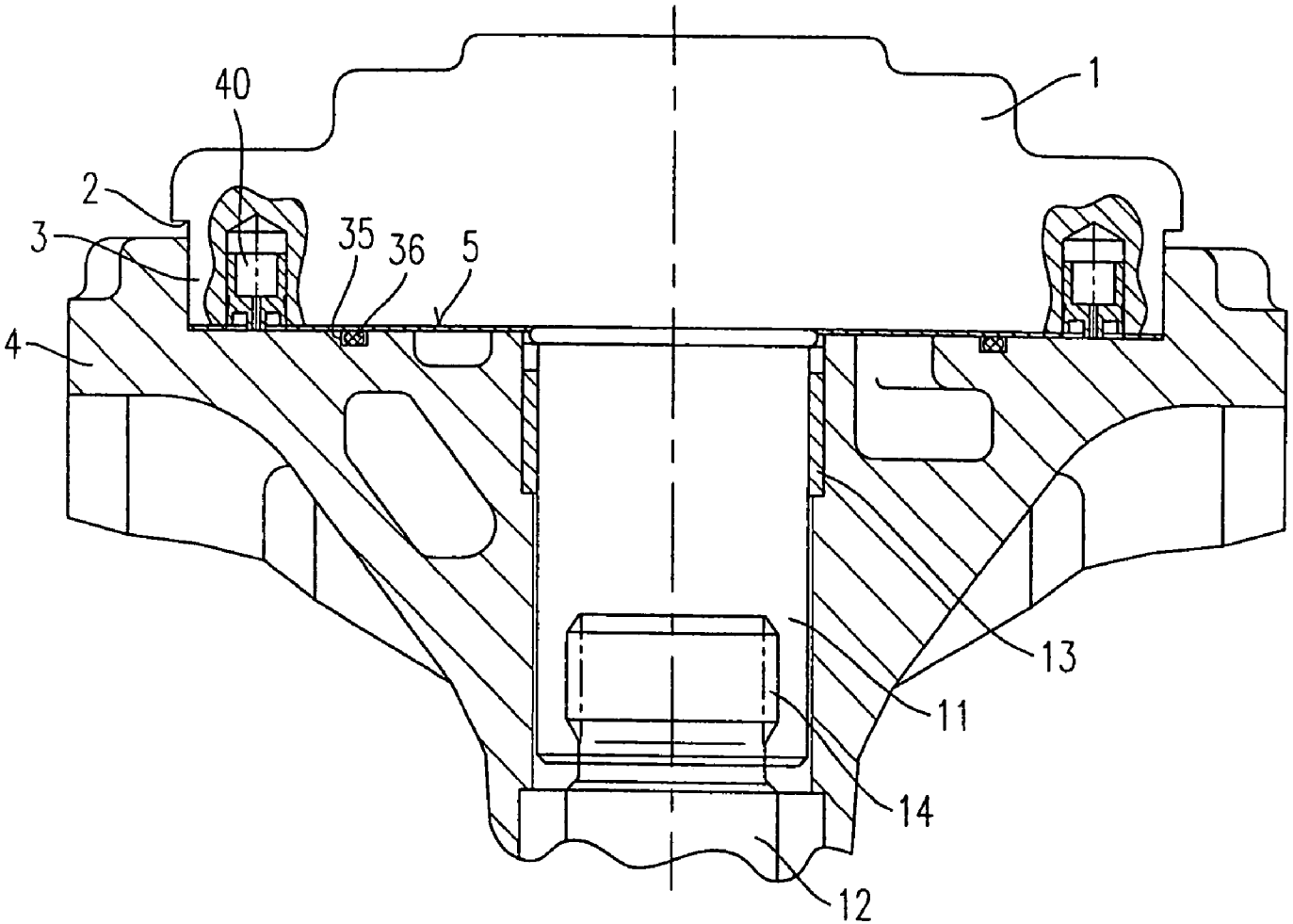
Figure 5A:
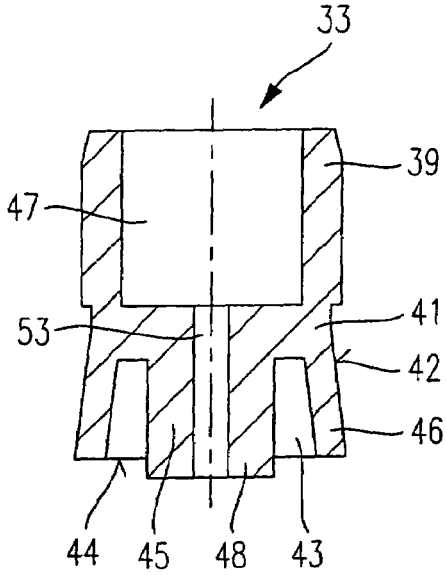
Figure 5B:
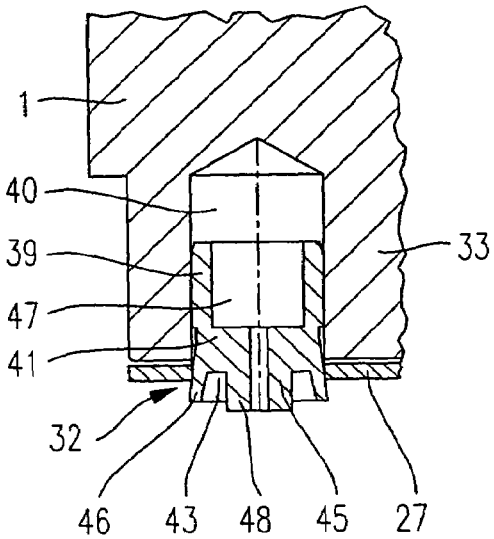
Figure 5C:
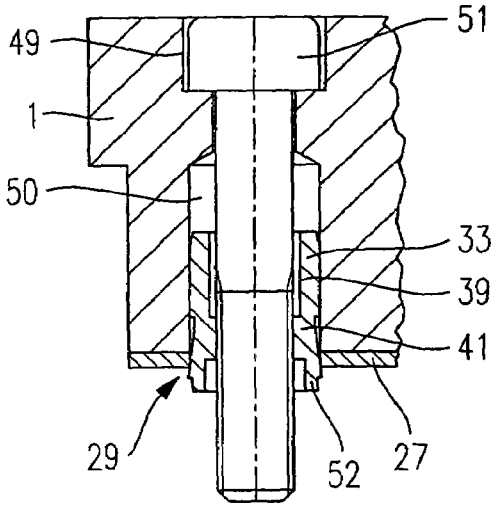

Two embodiments of the invention are illustrated in the drawings and described in detail below. The drawings show:

FIG. 1 a cross section of a gear pump according to the invention with a holding element according to the invention in the initial assembled state (on the left) and in the final assembled state (on the right);

FIG. 2 a plan view of a gear pump;

FIG. 3 a plan view of a cover plate;

FIG. 4 a cross section of a connection between a connection plate of a hydraulic pump, a cover plate and a pump cover;

FIG. 5A an enlarged cross section of a first embodiment of a holding element according to the invention;

FIG. 5B an enlarged cross section of a first embodiment of a holding element according to the invention in the initial assembled state in the region VB of FIG. 1 and FIG. 5C an enlarged cross section of a second embodiment of a holding element according to the invention in the initial assembled state.

The gear pump according to the invention and the holding element according to the invention in the two forms of construction are described below with reference to FIGS. 1 to 5C.

FIGS. 1 and 2 show a cross section of a gear pump 100. The gear pump 100 comprises a pump cover 1, which has a rotationally symmetrical cross section relative to an axis A. The pump cover 1, which primarily has a cylindrical volume, has at the volume half facing the hydraulic pump a step 2, which is directed towards the axis of rotation A and used to guide the pump cover 1 in the recess 3 of the connection plate 4 of the hydraulic pump. In the pump cover 1 in the bottom area 5 directed towards the connection plate 4 a recess 6 is provided, which is rotationally symmetrical relative to the axis of rotation A. As this recess 6 in terms of its depth extends up to the height of the top area 7, the pump cover 1 has an elevated portion, which is rotationally symmetrical relative to the axis of rotation A and has an enlarged diameter compared to the diameter of the recess 6. In the direction of the connection plate 4 the recess 6 verges in a stepped manner into an enlarged recess 9, which is formed rotationally symmetrically relative to an axis of rotation B disposed eccentrically relative to the axis of rotation A.

Disposed in the recess 6 is a plain bearing 10, in which a plug-in shaft 11 is rotatably mounted. This plug-in shaft 11 is driven by a drive shaft 12 of the hydraulic pump and additionally mounted in the plain bearing 13 of the connection plate 4. The plug-in shaft 11 is connected by a connection 14—e.g. a splined plug-in connection—to the drive shaft 12. In the region of the recess 9 of the pump cover 1 a rotationally symmetrical internal rotor 16 with external gearing 17 is fastened by a splined key 15 in a rotationally fixed manner to the plug-in shaft 11. The splined key 15 is in this case inserted into a keyway 18 of the plug-in shaft 11 and into a keyway 19 of the internal rotor 16. The height of the internal rotor 16 corresponds to the depth of the recess 9.

At the periphery of the rotationally symmetrical recess 9 an external rotor 19 with external gearing 20 is rotatably mounted. The tooth profile of the internal gearing 20 of the external rotor 19 corresponds to the tooth profile of the external gearing 17 of the internal rotor 16. The face width of internal rotor 16 and external rotor 19 is also identical. The circle diameter of the internal rotor 17 is designed smaller than the circle diameter of the external rotor 19. For this reason and because of the eccentricity of the axis of rotation A of the internal rotor 16 relative to the axis of rotation B of the external rotor 19, internal rotor 16 and external rotor 19 are in mesh via their internal gearing 17 and external gearing 20 respectively only in an angle-of-rotation range $\alpha$. This angle-of-rotation range $\alpha$ is situated in the angle-of-rotation range of the axis of rotation B that is symmetrical relative to the connection section between axis of rotation A and axis of rotation B. In the angle-of-rotation range $\beta$, which lies opposite the angle-of-rotation range $\alpha$, the distance between the external gearing 17 of the internal rotor 16 and the internal gearing 20 of the external rotor 19 is at its greatest.

To enable the space remaining in the recess 9 between the internal rotor 11 and in the external rotor 19 to be divided into two separate pressure chambers—the admission pressure chamber 21 and the low-pressure chamber 22, this distance between the internal rotor 11 and the external rotor 19 is bridged by a sickle-shaped web 23, which is disposed on the area 24 of the recess 9 and directed towards the connection plate 4. In the angle-of-rotation range $\beta$, the inner lateral surface 25 of the sickle-shaped web 23 is in contact with at least one tooth of the internal rotor 17. In the angle-of-rotation range $\beta$, the outer lateral surface 26 of the sickle-shaped web 23 is in contact with at least one tooth of the external rotor 19.

For closing the recess 9, a cover plate 27 is fastened to the bottom area 5 of the pump cover 1 and according to FIG. 3 has in its centre a circular opening 28 with a diameter that is slightly larger than the outside diameter of the plug-in shaft 11. The cover plate 27 is screw-fastened through a plurality of third bores 29 to the pump cover 1 and/or to the connection plate 4. The cover plate 27, in the two angle-of-rotation ranges $\gamma$ and $\delta$ delimited by the angle-of-rotation ranges $\alpha$ and $\beta$, has in each case a kidney-shaped opening 30 and 31. Each of these kidney-shaped openings 30 and 31 tapers in the direction of the angle-of-rotation range $\alpha$. The kidney-shaped opening 30 of the cover plate 27 connects the admission pressure chamber 21 of the gear pump 100 by a likewise kidney-shaped opening of the connection plate 4, which is not shown in the drawing, to the intake channel of the hydraulic pump. The kidney-shaped opening 31 of the cover plate 27 connects the low-pressure chamber 22 of the gear pump 100 by a likewise kidney-shaped opening of the connection plate 4, which is likewise not shown in the drawing, to a hydraulic tank at low-pressure level. The cover plate 27 moreover has second bores 32 for guiding the holding elements 33 described below.

In a first annular recess 33 in the bottom area 5 of the pump cover 1 a first sealing ring 34 is provided for sealing off the admission pressure chamber 21 and/or the low-pressure chamber 22 from the environment. In an entirely analogous manner and with an identical function, a second annular recess 35 for receiving a second sealing ring 36 is likewise provided at the opposite side of the cover plate 27 in the connection plate 4. In the region of the central bore 28 of the cover plate 27 that is not filled by the plug-in shaft 11, a ring 38 is mounted on the plug-in shaft 11 at the height of the cover plate 27 in a groove 37 provided for this purpose. The function of this ring 38 is the axial fixing of the plug-in shaft in the pump cover 1 and/or in the connection plate 4.

FIG. 5A shows the cross section of a first form of construction of a holding element 33. It comprises a cylindrical partial body 39, the outside diameter of which is slightly larger than the inside diameter of a first bore 40 provided in the bottom area 5 of the pump cover 1. When in the course of the initial assembly process the cylindrical partial body 39 of the holding element 33 is inserted into the first bore 40 of the pump cover 1, the diameter difference leads to a deformation of the flexible cylindrical partial body 39, which is preferably made of a plastics material. This deformation gives rise to the build-up in the flexible cylindrical partial body 39 of a bias force, which enables a force-locking connection—an interference fit—between the holding element 33 and the pump cover 1. Alternatively, the cylindrical partial body 39 may have on its cylindrical lateral surface scales, which improve the frictional connection between holding element 33 and pump cover 1.

Adjoining the cylindrical partial body 39 of the holding element 33 is a conical partial body 41. This conical partial body 41 of the holding element 33 is passed through the second bore 32 of the cover plate 27 according to FIG. 1 (left half of the drawing) and/or FIG. 5B in such a way that the bottom edge of the second bore 32 of the cover plate 27 is seated on the outer surface 42 of the conical partial body 41. The conical partial body 41 in said case presses the cover plate 27 in such a way against the bottom areas 5 of the pump cover 1 that by means of the holding element 33 a force-locking connection is produced between the cover plate 27 and the pump cover 1.

The weight of the cover plate 27 in said case presses in such a way upon the outer surface 42 of the conical partial body 41 of the holding element 33 that it comes its slight deformation of the conical partial body 41 made of a flexible plastics material. This deformation of the conical partial body 41 is facilitated by a third annular recess 43 in the area 44 of the conical partial body 41. This third annular recess 43 tapers, in the embodiment, to its deepest point in such a way as to form, in the centre of the conical partial body 41, a cylindrical bottom partial body 45 and, in the periphery of the conical partial body 41, a hollow-cone-shaped bottom partial body 46 of a constant wall thickness.

The holding element 33 has a continuous, stepped inner bore 47, 53, comprising the inner bore portion 47 situated in the cylindrical partial body 39 and the inner bore portion 53 situated in the conical partial body, for ventilating the first bore 40 in the pump cover 1. The inside diameter of the inner bore portion 47 situated in the cylindrical partial body 39 is in said case coined markedly larger than the inside diameter of the inner bore portion 53 situated in the conical partial body 41.

Compared to the area 44 of the conical partial body 41, the cylindrical bottom partial body 45 has a projecting length 48, which corresponds at least to the thickness of the cover plate 27. Thus, in the final assembled state of the gear pump 100, once the pump cover 1 has been fastened by means of the cover plate 27 to the connection plate 4 of the hydraulic pump, the holding element 33 is positioned in such a way into the first bore 40 of the pump cover 1 that the conical partial body 41 according to FIG. 1 (right half of the drawing) is situated entirely in the first bore 40 and hence is no longer in contact with the connection plate 27.

FIG. 5C shows a second form of construction of a holding element 33. Here, the holding element 33 is not passed into the second bore 32 of the cover plate 27 and then inserted into the first bore 40 of the pump cover 1 but in a cost-saving manner is passed into the third bore 29, which is provided for fastening the cover plate 27 to the pump cover 1 and/or to the connection plate 4, and then inserted into the fourth bore 49 in the pump cover 1, which bore is likewise provided for fastening pump cover 1, cover plate 27 and connection plate 4. For this purpose, each of these fourth bores 49 in the pump cover 1 is enlarged in the region of the bottom area 5 of the pump cover 1 to form a fifth bore 50 of the size of the first bore 40.

Through the inner bore 47, 53 of the holding element 33 of the second form of construction a screw 51 is passed for screw-fastening the pump cover 1, the cover plate 27 and the connection plate 4. For this purpose, the inside diameter of the inner bore portion 53 situated in the conical partial body 41 is made markedly larger than in the first form of construction of the holding element 33.

In the second embodiment of the holding element 33, the cylindrical bottom partial body 45 is dispensed with entirely. The projecting length 48 of the cylindrical bottom partial body 45 in the first form of construction of the holding element 33 is realized in the second form of construction of the holding element as a hollow-cylindrical bottom partial body 52, which adjoins the hollow-cone-shaped bottom partial body 46. This hollow-cylindrical bottom partial body 52 acting as a projecting length has at least the same height as the thickness of the cover plate 27 so that, in the case of this second form of construction of the holding element 33 too, the conical partial body 41 in the final assembled state of the gear pump 100 is positioned entirely in the fifth bore 50 and no longer has any contact with the cover plate 27.

During routine operation of the hydraulic pump, hydraulic fluid at a low pressure level is drawn from a hydraulic tank, through a feed line, the kidney-shaped opening of the connection plate 4 and the kidney-shaped opening 31 of the cover plate 27 into the low-pressure chamber 22 in the pump cover 1. The low-pressure hydraulic fluid is compressed by the gear pump 100, comprising the internal rotor 16 and the external rotor 19, during the transfer from the low-pressure chamber 22 to the admission pressure chamber 21 and is delivered through the kidney-shaped opening 30 of the cover plate 27, the kidney-shaped opening of the connection plate 4 and a discharge line into the intake channel of the hydraulic pump.

The invention is not restricted to the illustrated embodiments. The features of the individual embodiments may also be combined with one another in any desired manner.

The invention claimed is:

1. A gear pump comprising a pump cover, an internal rotor disposed rotatably in a recess of the pump cover and formed in a rotationally fixed manner on a drivable plug-in shaft, and an external rotor rotatably disposed in the recess of the pump cover in such an eccentric manner relative to the axis of rotation (A) of the internal rotor that the external rotor is in mesh with the internal rotor only in a first angle-of-rotation range ($\alpha$) and in a second angle-of-rotation range ($\beta$) lying opposite the first angle-of-rotation range ($\alpha$) is in contact with an inner surface of a web, which is disposed in the recess and is in turn in contact at its outer surface with the external rotor, so that after closing of the recess by a cover plate there is formed in the recess an admission pressure chamber and a low-pressure chamber, wherein a holding element, which is held in the pump cover, in the initial assembled state of the gear pump holds the cover plate at a fixed angle of rotation on the pump cover;

said holding element being held in a first recess formed in the pump cover and in the initial assembled state of the gear pump holding the cover plate by a second recess formed in the cover plate at a fixed angle of rotation on the pump cover;

said holding element comprising a cylindrical partial body having outside diameter which is slightly larger than the inside diameter of the first recess, so that during the course of insertion of the holding element into the first recess, the cylindrical partial body is imparted a specific radial bias causing a force-locking connection between the holding element and the pump cover; and said cylindrical partial body of the holding element for receiving a screw having an inner bore with an inside diameter which approximately corresponds to the outside diameter of the screw.

2. The gear pump according to claim 1, wherein the cover plate in the final assembled state of the gear pump is released by the holding element.

3. The gear pump according to claim 1, wherein the holding element in the final assembled state of the gear pump is displaced in the first recess to such an extent that the cover plate is no longer held by the holding element.

4. The gear pump according to claim 1, wherein the holding element is made of a deformable plastics material.

5. The gear pump according to claim 1, wherein the surface of the cylindrical partial body of the holding element has scales.

6. The gear pump according to claim 1, wherein adjoining the cylindrical partial body is a conical partial body, which is passed through the second recess and in the final assembled state of the pump cover is in contact by its outer surface with the second recess of the cover plate in such a way that by means of the holding element a positive connection is realized between the pump cover and the cover plate.

7. The gear pump according to claim 1, wherein a portion of an inner bore, which is situated in the conical partial body in a continuation of an inner bore portion situated in the cylindrical partial body and the diameter of which is designed smaller than the diameter of the inner bore portion situated in the cylindrical partial body, is used to ventilate the first recess of the pump cover.

8. The gear pump according to claim 6, wherein the conical partial body in its area has an annular recess, the annular area of which tapers with increasing recess depth in such a way that up to the height of the base of the annular recess there are formed in the centre of the conical partial body a cylindrical bottom partial body and at the periphery of the conical partial body a hollow-cone-shaped bottom partial body of a constant wall thickness.

9. The gear pump according to claim 8, wherein the conical partial body owing to the annular recess is deformable in such a way that it is introducible by its hollow-cone-shaped bottom partial body entirely into the first recess in the final assembled state of the gear pump.

10. The gear pump according to claim 8, wherein the cylindrical bottom partial body is lengthened compared to the area of the conical partial body by the thickness of the cover plate, so that in the final assembled sate of the gear pump the hollow-cone-shaped bottom partial body is introduced entirely into the first recess and there is therefore no longer any contact with the cover plate.

11. The gear pump according to claim 8, wherein the hollow-cone-shaped bottom partial body is adjoined by a hollow-cylindrical bottom partial body, the height of which corresponds to the thickness of the cover plate, so that in the final assembled state of the gear pump the hollow-cone-shaped bottom partial body is introduced entirely into the first recess and there is therefore no longer any contact with the cover plate.

12. The gear pump according to claim 1, wherein the web in the recess of the pump cover is sickle-shaped.

13. The gear pump according to claim 1, wherein in the final assembled state of the gear pump the pump cover with the cover plate at a fixed angle of rotation is fastened by means of screw connections to a connection plate of a hydraulic pump.

14. The gear pump according to claim 13, wherein the admission pressure chamber is connected by kidney-shaped recesses in the cover plate and the connection plate to an intake channel of they hydraulic pump and the low-pressure chamber is connected by kidney-shaped recesses in the cover plate and the connection plate to a hydraulic tank.

15. The gear pump according to claim 13, wherein the plug-in shaft is rotatably mounted in a first plain bearing in the pump cover and in a second plain bearing in the connection plate.

16. The gear pump according to claim 1, wherein the internal rotor is fastened by a clamping key, which engages into a keyway of the internal rotor, in a rotationally fixed manner to the plug-in shaft.

17. The gear pump according to claim 1, wherein the plug-in shaft in the final assembled state of the gear pump is fixed in its axial position by means of a round ring, which is fitted on the plug-in shaft at the level of the cover plate.

18. A holding element comprising a cylindrical partial body, which is introducible into a recess of a first article with a simultaneous build-up of a radial bias in such a way that a force-locking connection is established between the holding element and the first article, and a conical partial body, which adjoins the cylindrical partial body and in an initial assembled state is passed through a recess of a second article and is in contact with the recess of the second article in such a way that by means of the holding element a positive connection is realized between the first article and the second article, said cylindrical bottom partial body being lengthened compared to the area of the conical partial body by the thickness of the second article, so that the second assembled state the hollow-cone-shaped bottom partial body is inserted entirely into the recess of the first article and there is therefore no longer any contact with the second article.

19. The holding element according to claim 18, wherein the surface of the cylindrical partial body of the holding element has scales.

20. The holding element according to claim 18, wherein the cylindrical partial body of the holding element for receiving a screw has an inner bore, the inside diameter of which approximately corresponds to the outside diameter of the screw.

21. The holding element according to claim 18, wherein an inner bore portion, which is situated in the conical partial body in continuation of an inner bore portion situated in the cylindrical partial body and the diameter of which is designed smaller than the diameter of the inner bore portion situated in the cylindrical partial body, is used to ventilate the recess of the first article.

22. The holding element according to claim 18, wherein the conical partial body in its area has an annular recess, the annular area of which tapers with increasing recess depth in such a way that up to the height of the base of the annular recess there are formed in the center of the conical partial body a cylindrical bottom partial body and at the periphery of the conical partial body a hollow-cone-shaped bottom partial body of a constant wall thickness.

23. The holding element according to claim 22, wherein the conical partial body owing to the annular recess is deformable in such a way that in a second assembled state it is introducible by its hollow-cone-shaped bottom partial body entirely into the recess of the first article.

24. The holding element according to claim 22, wherein the hollow-cone-shaped bottom partial body is adjoined by a hollow-cylindrical bottom partial body, the height of which corresponds to the thickness of the second article, so that in the final assembled state of the first and second article the hollow-cone-shaped bottom partial body is inserted entirely into the recess of the first article and there is therefore no longer any contact with the second article.

25. A holding element comprising a cylindrical partial body, which is introducible into a recess of a first article with a simultaneous build-up of a radial bias in such a way that a force-locking connection is established between the holding element and the first article, and a conical partial body, which adjoins the cylindrical partial body and in an initial assembled state is passed through a recess of a second article and is in contact with the recess of the second article in such a way that by means of the holding element a positive connection is realized between the first article and the second article, the conical partial body in its area having an annular recess, the annular area of which tapers with increasing recess depth in such a way that up to the height of the base of the annular recess there are formed in the center of the conical partial body a cylindrical bottom partial body and at the periphery of the conical partial body, a hollow-cone-shaped bottom partial body of a constant wall thickness, and the hollow-cone-shaped bottom partial body being adjoined by a hollow-cylindrical bottom partial body, the height of which corresponds to the thickness of the second article, so that in the final assembled state of the first and second article the hollow-cone-shaped bottom partial body is inserted entirely into the recess of the first article and there is therefore no longer any contact with the second article.

26. The holding element according to claim 25, wherein the surface of the cylindrical partial body of the holding element has scales.

27. The holding element according to claim 25, wherein the cylindrical partial body of the holding element for receiving a screw has an inner bore, the inside diameter of which approximately corresponds to the outside diameter of the screw.

28. The holding element according to claim 25, wherein an inner bore portion, which is situated in the conical partial body in continuation of an inner bore portion situated in the cylindrical partial body and the diameter of which is designed smaller than the diameter of the inner bore portion situated in the cylindrical partial body, is used to ventilate the recess of the first article.

29. The holding element according to claim 25, wherein the conical partial body owing to the annular recess is deformable in such a way that in a second assembled state it is introducible by its hollow-cone-shaped bottom partial body entirely into the recess of the first article.

30. The holding element according to claim 25, wherein the hollow-cone-shaped bottom partial body is adjoined by a hollow-cylindrical bottom partial body, the height of which corresponds to the thickness of the second article, so that in the final assembled state of the first and second article the hollow-cone-shaped bottom partial body is inserted entirely into the recess of the first article and there is therefore no longer any contact with the second article.

* * * * *